United States Patent [19]

O'Loughlin

[11] Patent Number: 4,875,876

[45] Date of Patent: Oct. 24, 1989

[54] ELECTRICAL CONNECTOR FOR OVERLAPPED CONDUCTORS

[75] Inventor: Francis A. O'Loughlin, Scotch Plains, N.J.

[73] Assignee: Thomas & Betts Corporation, Bridgewater, N.J.

[21] Appl. No.: 239,107

[22] Filed: Aug. 31, 1988

[51] Int. Cl.[4] ..... H01R 4/38

[52] U.S. Cl. ..... 439/431; 439/442; 439/792

[58] Field of Search ..... 439/98, 99, 411–414, 439/421–424, 431, 432, 442, 791, 792, 801, 815, 781, 782; 174/71 R, 94 S

[56] References Cited

U.S. PATENT DOCUMENTS

| | | | |
|---|---|---|---|
| 3,514,528 | 5/1970 | Ray | 174/84 |
| 3,594,704 | 7/1971 | Fischer | 339/97 |
| 3,643,006 | 2/1972 | Ance | 439/421 |
| 3,701,839 | 10/1972 | Smith | 174/78 |
| 3,715,705 | 2/1973 | Kuo | 339/98 |
| 3,753,204 | 8/1973 | Thompson et al. | 439/411 |
| 3,761,867 | 9/1973 | Churla | 339/98 |
| 3,891,293 | 6/1975 | Jones | 339/97 |
| 4,025,152 | 5/1977 | Jacobson | 439/781 |
| 4,026,619 | 5/1977 | Gillemot | 339/14 |
| 4,176,893 | 12/1979 | Olszewski et al. | 439/411 |
| 4,195,895 | 4/1980 | Ziegler | 439/411 |
| 4,256,359 | 3/1981 | Storck | 339/97 |
| 4,551,579 | 11/1985 | Takasaki | 174/88 |
| 4,558,915 | 12/1985 | Greenwood | 339/97 |
| 4,560,224 | 12/1985 | Weisenburger | 339/97 |

FOREIGN PATENT DOCUMENTS

| | | | |
|---|---|---|---|
| 2161998 | 1/1986 | United Kingdom | 439/411 |

*Primary Examiner*—Gary F. Paumen

*Attorney, Agent, or Firm*—Robert M. Rodrick; Salvatore J. Abbruzzese

[57] ABSTRACT

An electrical connector for connecting overlapped conductors is disclosed. The connector is similar to connectors of the clam shell type haivng a pair of compressibly-movable hingedly-connected ends which accommodate the conductors therebetween. The ends of the connectors are positioned in spaced mutually parallel relationship. The conductors are supported therebetween. A hinge connecting the two ends is collapsibly-deformable to maintain the relative parallel positions of the ends throughout compression of the connector.

12 Claims, 4 Drawing Sheets

FIG. 2
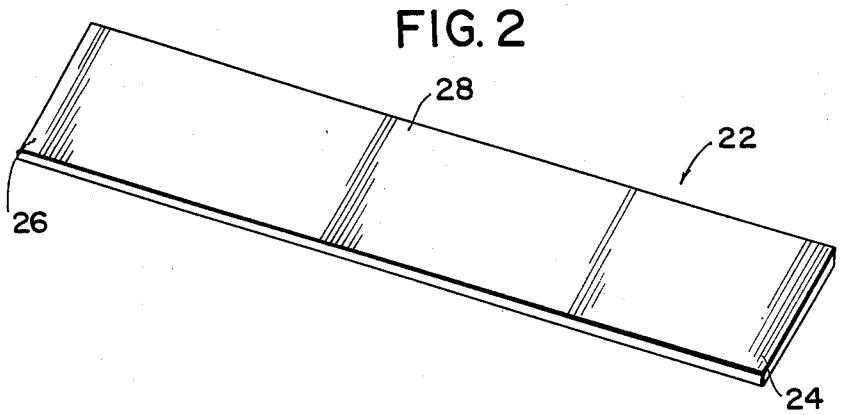
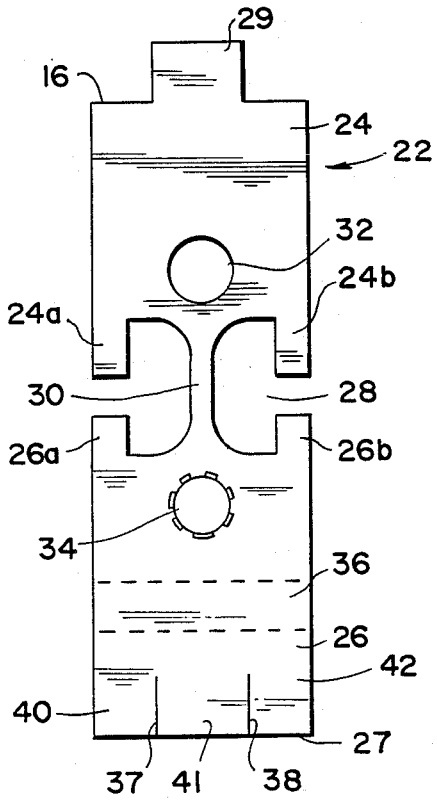
FIG. 3

ELECTRICAL CONNECTOR FOR OVERLAPPED CONDUCTORS

FIELD OF THE INVENTION

The present invention relates generally to an electrical connector for overlapped electrical conductors and more particularly relates to a compression electrical connector for connecting bared conductors in overlapped relation to provide electrical continuity therebetween.

BACKGROUND OF THE INVENTION

Many techniques have been used for connecting two electrical conductors to establish electrical continuity therebetween. The most commercially successful connectors are the type which are reliable, inexpensive and easy to use in the field. One type of electrical connector which has been particularly useful in making quick, inexpensive connection between two conductors are connectors of the clam shell variety where one or more conductors are placed within the clam shell and the clam shell is crimped onto the conductors to effect electrical connection therebetween.

Three examples of connectors of this type are shown in U.S. Pat. Nos. 4,256,359, 4,560,224 and 4,558,915. Each of these patents shows, in one respect or another, the typical operation of a clam shell type connector. One or more conductors are disposed within the clam shell and by use of a suitable crimping tool, upper and lower halves of the clam shell are compressed about a central bending line to engage the conductors supported therein. Each half of the clam shell may include inwardly directed teeth to provide biting engagement with the conductors to achieve better electrical connection therewith. An appropriate locking element may also be provided on the connector to lock the two halves of the clam shell together preventing inadvertent disconnection of the conductor from the connector.

While clam shell type connectors, such as the type described in the above-identified patents, more than adequately serve their intended function, that is, electrically terminating one or more relatively flexible electrical conductors, these connectors may not be suitable for electrically connecting two overlapped rigid metallic conductors in the same fashion. As is typical of most clam shell type connectors, connection is made by folding the clam shell at a central bending location. Thus, the two halves of the clam shell are brought together at an angular disposition to enclose the conductors inserted therein. When working with relatively rigid metallic conductors this angular compression may have a tendency to squeeze, or otherwise, force the rigid conductors out from the clam shell during closing.

Also, as the portion of the clam shell nearest the bending line typically provides less area between the upper and lower halves, connection is usually made nearest the distal extents of the clam shell halves. Again, it can be seen that there exists a tendency to squeeze the conductors out from the halves of the clam shell.

It is desirable to provide a simple electrical connector similar to that of the clam shell variety which would prevent the angular movement of the connector halves and provide a more secure connection between relatively rigid metallic conductors.

SUMMARY OF THE INVENTION

It is an object of the present invention to provide an improved electrical connector for connecting electrical conductors in overlapped fashion.

It is a further object of the present invention to provide an electrical connector similar to clam shell style connectors which will securely retain conductors therein preventing inadvertent dislodgement of the conductors during termination.

In the efficient attainment of these and other objects the present invention provides an electrical connector similar to that of the clam shell variety having a connector body including a first conductive planar member and a second conductive planar member integrally attached by a deformable, collapsible hinge therebetween. The planar members are positioned in spaced-apart, substantially parallel disposition providing a passageway therebetween for accommodating one or more electrical conductors. Progressive urging means is included for urging the first and second planar members into intimate contact around the conductors inserted therebetween. The hinge connecting the two planar members is deformable in such a manner to collapse during urging to permit the planar members to maintain their relative parallel position throughout the termination process.

In a method aspect of the present invention, an electrical connector is formed by providing a elongate, flat extent of metal stock material and selectively removing a central portion thereof to provide a hinge of reduced width bridging the first and second ends of the metal member. The metal member is then folded at the hinge to dispose the ends thereof in substantially spaced-apart mutual parallel relation thus forming a passageway therebetween for accommodating electrical conductors. An urging element is provided for imparting relative movement between the first and second ends to place the connector in intimate contact with the conductors inserted therebetween.

As shown by way of a preferred embodiment herein the invention provides a screw member insertable through the folded ends of the metallic member such that upon continued screw tightening, the two ends are brought into intimate contact with the conductors. The two ends of the connector are maintained in substantially parallel relationship during compression by the outward bowing or collapsing of the deformable hinge member. This prevents angular movement of the ends with respect to one another.

Further, the present invention contemplates the use of an intermediate contact member disposed between the two connected conductors, which is also secured by the urging screw. This intermediate member includes skived teeth on either side thereof to help engage and contact the conductors therein.

BRIEF DESCRIPTION OF THE DRAWINGS

FIG. 2 is a perspective showing of an extent of flat metal sheet stock used to form the connector body shown in FIG. 1.

FIG. 3 shows the flat metal sheet stock extent of FIG. 2 having portions selectively removed in accordance with the present invention.

DETAILED DESCRIPTION OF THE PREFERRED EMBODIMENT

Figure 1:
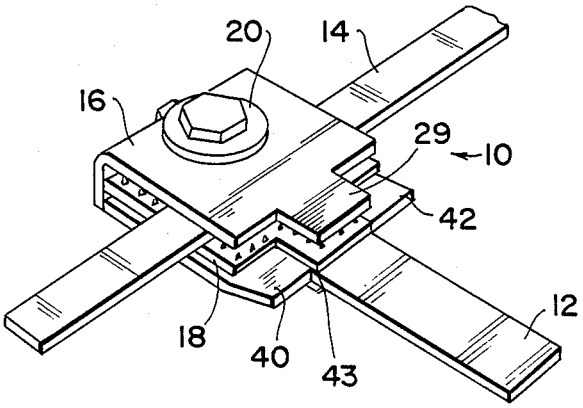
FIG. 1 is a perspective showing of the assembled connector of the present invention including a pair of electrical conductors terminated thereto.

Referring to FIG. 1, connector assembly 10 is shown terminating a pair of electrical conductors 12 and 14. Connector assembly 10 includes a connector body 16, an intermediate contact member 18 and a securement-/urging screw 20 which secures electrical conductors 12 and 14 to the connector assembly 10.

The present invention finds particular utility in the telecommunications industry where it is often necessary to interconnect the metallic shields of multi-conductor telecommunications cables (not shown) to one another to ensure that the shields are placed at the same electrical ground potential.

Electrical conductors 12 and 14 are shown as flat, elongate rectangular tape or ribbon conductors, and are typically used in the telecommunications industry to connect the shields of a telecommunication cable. However, occasionally round wire may also be used to make such interconnection.

Referring now to FIGS. 2 through 6 the formation of connector body 16 may be described. FIG. 2 shows a flat, metal stock extent 22 which is an elongate member having a first end 24, a second end 26 and a central intermediate portion 28. Flat stock extent 22 is typically a formed piece of plated copper or other electrically conductive metallic material. A conventional stamping die and other known processing techniques are used to selectively remove portions of flat stock extent 22 to form the shape shown in FIG. 3, which more closely resembles connector body 16 of FIG. 1. The first end 24 is stamped in such a manner as to form a centrally disposed protruding tongue 29. Intermediate portion 28 is stamped so as to have material removed therefrom leaving a web or hinge 30 of reduced width joining first end 24 with second end 26. The stamping of intermediate portion 28 also leaves two pairs of centrally directed legs 24*a*, 24*b* and 26*a*, 26*b*. Screw apertures 32 and 34 are placed respectively in first end 24 and second end 26. Apertures 32 and 34 are equally spaced from hinge 30. Aperture 32 is typically a simple formed opening while aperture 34 is a drawn opening having internal screw threads as is shown in more detail in FIGS. 5 and 6.

Second end 26 is further formed to have a transverse, semi-cylindrical channel 36 extending thereacross. As is more fully shown in FIG. 5, this open ended channel is designed to accommodate a round wire conductor (not shown) as will be described in further detail hereinbelow. Second end 26 further includes two spaced, parallel slits 37 and 38 extending from the distal extent 27 thereof. Slits 37 and 38 divide the distal extent 27 of second end 26 into three finger portions 40, 41 and 42. Lateral fingers 40 and 42 are bent slightly upwardly with respect to central finger 41 as is shown in FIG. 6.

Figure 4:
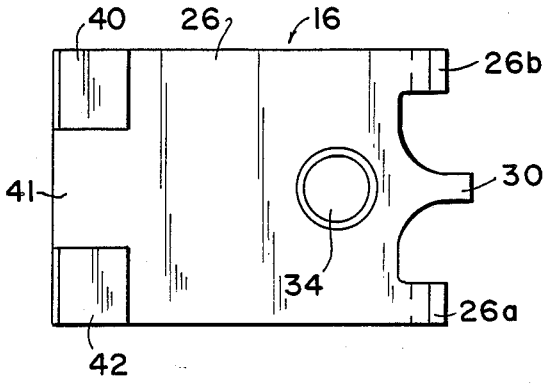
FIGS. 4, 5 and 6 show respectively bottom, side and rear plan views of the connector body of the present invention.
Figure 5:
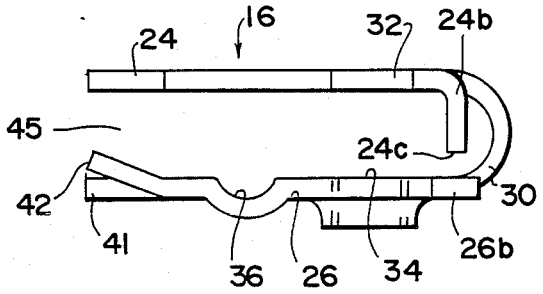
Figure 6:
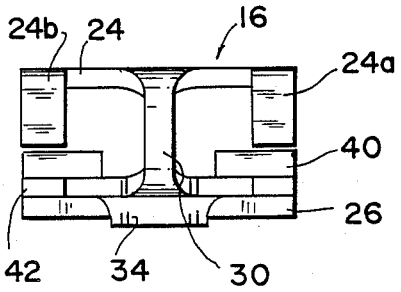

Referring now to FIGS. 4, 5 and 6, further formation of connector body 16 may be seen. The stamped, flat stock extent 22 (FIG. 3) is bent or folded about hinge 30 to dispose the first end 24 directly over and aligned with second end 26. As shown in FIG. 6, aperture 32 will be vertically aligned with aperture 34. Hinge 30 will be bowed or curved at the juncture between first end 24 and second end 26. After proper formation, first end 24 is disposed in a plane which is substantially parallel to the plane of second end 26. Legs 24*a* and 24*b* of first end 24 are bent downwardly at a right angle toward second end 26. Distal extents 24*c* of legs 24*a*, 24*b* are spaced from and directly over legs 26*a*, 26*b* of second end 26.

Figure 7:
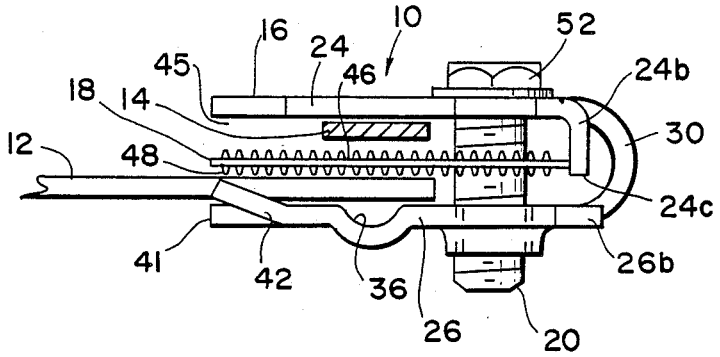
FIG. 7 is a side view, partially in section, of the assembled connector of FIG. 1 including the electrical conductors disposed therein.
Figure 8:
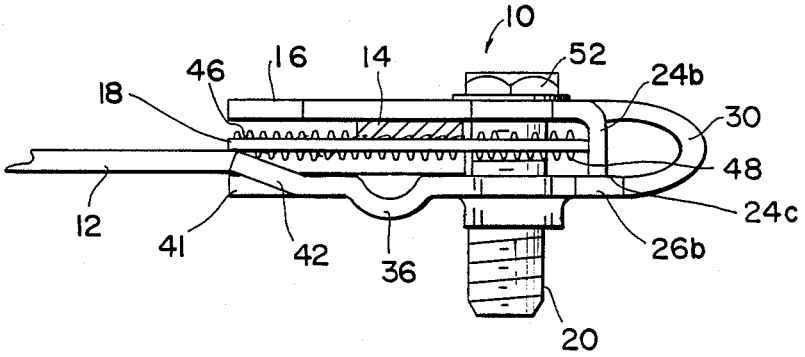
FIG. 8 is a view similar to that in FIG. 7 showing the connector in secured condition.

As shown in FIGS. 7 and 8 connector body 16 has a generally reverse C-shaped profile forming an internal passageway 45 which may accommodate electrical conductors 12 and 14 therein to place the conductors 12 and 14 in electrical connection.

Figure 9:
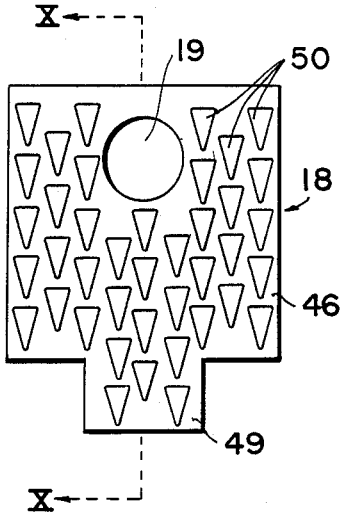
FIGS. 9 and 10 show in top and sectional views the intermediate contact member of the connector of FIG. 1.
Figure 10:
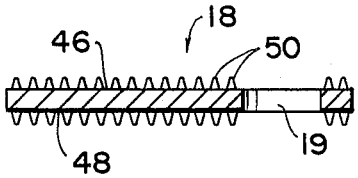

Referring now to FIGS. 9 and 10 intermediate contact member 18 is shown. Contact member 18 is also formed from an extent of flat stock metal material, typically copper, and is stamped to have a generally square shape with a centrally extending tongue 49. Intermediate contact member 18 also includes an aperture 19 therethrough adjacent one end thereof. Intermediate contact member 18 includes a first planar surface 46 and an opposed second planar surface 48. Each of the opposed planar surfaces 46 and 48 includes a plurality of skived projections 50 extending outwardly therefrom. These projections 50 are disposed over substantially the entire area of intermediate contact member 18.

Referring again to FIGS. 7 and 8, intermediate contact member 18 is positioned between first end 24 and second end 26 of connector body 16. A externally threaded securement/urging screw 20 is inserted through aperture 32 of first end 24, aperture 19 of intermediate contact member 18 and aperture 34 of second end 26. As can be seen in FIG. 6, intermediate contact member 18 will be secured within passageway 45. Tongue 49 is positioned directly beneath tongue 29 and above central finger 41 of connector body 16.

Having described the formation of connector assembly 10, the connection of two electrical conductors 12 and 14 may be described.

Referring to FIGS. 1, 7 and 8, electrical conductors 12 and 14 are placed in connector assembly 10 in substantially overlapped relationship with conductor 12 extending at a right angle with respect to conductor 14. Each of the conductors 12 and 14 are inserted in passageway 45 so that one conductor 14 is placed on the upper surface 46 of intermediate contact member 18 while the other conductor 12 is placed below the lower surface 48 of intermediate contact member 18. Conductor 12 is positioned against central finger 41 being retained from lateral movement by each of upwardly bent lateral fingers 40 and 42 which form a slot 43 therebetween. Conductor 12 is inserted into connector assembly 10 to a position where it nearly abuts against screw 20. Conductor 14 is positioned transverse with respect to conductor 12 and also may be placed adjacent screw 20. In this position conductors 12 and 14 are loosely retained in connector assembly 10.

In order to achieve electrical connection between conductor 14 and conductor 12, securement/urging screw 20 is tightened. As aperture 34 is internally screw threaded, screw tightening of screw 20 will cause second end 26 of connector body 16 to be brought up against the head 52 of screw 20. This will cause relative movement between first end 24 and second end 26 of connector body 16 thereby compressing passageway 45. As first end 24 and second end 26 are moved closer together, hinge 30 will compensate for such movement by collapsing outwardly. Since hinge 30 is constructed to be deformable rather than just merely a pivoting hinge, the outward bowing achieved by the collapse of hinge 30 will allow first end 24 and second end 26 to move in substantially relative parallel relationship. Continued screw tightening of screw 20 will cause conductors 12 and 14 to be placed in intimate contact with intermediate contact member 18. The projections 50 thereof will bite against the conductors 12 and 14 providing adequate electrical contact.

In the connected condition shown in FIG. 8, conductor 14 is shown secured between upper surface 46 of intermediate contact member 18 and the first end 24 of contact body 16. Similarly, conductor 12 is secured between lower surface 48 of intermediate contact member 18 and second end 26 of contact body 16. Electrical connection is established between conductors 12 and 14 through intermediate contact member 18. Also, connector body 16 itself is maintained in electrical connection with conductors 12 and 14.

Mechanical connection is maintained between conductors 12 and 14 by the essentially inward compressive force being maintained by ends 24 and 26 of connector body 16 against conductors 14 and 12 respectively. Since the ends 24 and 26 are maintained in substantially parallel position by the outward bowing of hinge 30, there is no tendency to squeeze or otherwise force rigid conductors 12 and 14 out from the ends 24 and 26. This provides superior electrical and mechanical connection in adverse environments where the connector assembly may be subject to vibration, movement and inadvertent contact.

In order to prevent over compression, the present invention further provides a mechanical stop. As ends 24 and 26 are compressed, distal extents **24*c* of first end 24*a*, 24*b* will move toward and engage legs 26*a*, 26*b* of second end 26. This will inhibit further screw tightening of securement/urging screw 20, thus preventing the connector body 16 from being crushed. This mechanical stop also prevents further collapse of hinge 30** once electrical connection is established.

As shown herein connector assembly 10 is used to connect two flat metallic tape or ribbon conductors 12 and 14. However, it is contemplated that, at least one round wire may also be connected in a similar manner. Second end 26 of connector body 16 includes a transverse, semi-cylindrical channel 36 which can accommodate and retain a round wire therein. The round wire would be captively supported therein for connection in a manner similar to that described above.

Various changes to the foregoing described and shown structures would now be evident to those skilled in the art. Accordingly, the particularly disclosed scope of the invention is set forth in the following claims.

I claim:

1. An electrical connector for connecting a pair of conductors, comprising:

a connector body including:

a first conductive planar member, a second conductive planar member and a deformable hinge which is narrow relative to the width of said planar members and which connects said first and second planar members and places said planar members in a substantially parallel relationship, said first and second planar members defining therebetween a passageway for accommodating said conductors in transverse overlapped relationship; and progressive urging means for progressively urging said first and second planar members toward one another for placing said overlapped conductors in electrical engagement, said hinge being deformable in a direction away from said passageway upon said urging of said first and second planar members to maintain said first and second planar members in a mutually parallel relationship.

2. An electrical connector of claim 1 wherein said first and second planar members are integral.

3. An electrical connector of claim 1 wherein said first planar member includes a first aperture therethrough, said second planar member includes a second internally-screw threaded aperture therethrough aligned with said first aperture, and wherein said progressive urging means includes an externally threaded screw insertable through said first and second apertures, progression of said screw into said aperture causing urging of said second planar member toward said first planar member.

4. An electrical connector of claim 1 further including an intermediate conductive element positioned between said first and second planar members, said intermediate conductive element having a first surface for engagement with one conductor of said pair and an opposed second surface for engagement with the other conductor of said pair.

5. An electrical connector of claim 4 wherein said intermediate conductive element includes a plurality of skived projections extending from each surface thereof for biting engagement with said conductors.

6. An electrical connector of claim 4 wherein at least one of said first and second planar members includes a slot for engagement with one conductor of said pair to prevent movement of said conductor in said passageway.

7. An electrical connector of claim 6 wherein said connector body is formed of copper.

8. An electrical connector of claim 7 wherein said intermediate conductive element is formed of copper.

9. An electrical terminal comprising:

an elongate body having a first planar end, a second planar end and a collapsible hinge therebetween which is narrow relative to the width of said planar ends, said first and second ends being positioned in substantially vertically-aligned mutually-parallel orientation, thereby forming a passageway therebetween for accommodating an electrical conductor therein; and urging means in engagement with said body, said urging means being relatively movable with respect to said body to urge said first and second ends toward one another to thereby compress said passageway to place said conductor in electrical engagement with said body, said hinge being deformably collapsible to maintain said first and second ends in said mutually-parallel orientation throughout said urging.

10. An electrical terminal of claim 9 wherein said first and second ends each include an aperture therethrough, said apertures being in vertical alignment.

11. An electrical terminal of claim 10 wherein said urging means includes a screw, insertable through said apertures, screw-tightening of said screw causing said urging of said first and second ends.

12. An electrical terminal of claim 9 further including mechanical stop means limiting relative movement of said first and second ends.

* * * * *